US006527655B2

(12) United States Patent
Sims et al.

(10) Patent No.: US 6,527,655 B2
(45) Date of Patent: Mar. 4, 2003

(54) COUNTING RACKET

(76) Inventors: Stewart Sims, 23 Tanglewood Rd., Newton, MA (US) 02459; Michael Sivan, Frontier 2000 Unit 508, Tower B New Mandarin Plaza, Kowloon (HK)

( * ) Notice: Subject to any disclaimer, the term of this patent is extended or adjusted under 35 U.S.C. 154(b) by 0 days.

(21) Appl. No.: 09/952,202

(22) Filed: Sep. 13, 2001

(65) Prior Publication Data

US 2002/0068652 A1 Jun. 6, 2002

Related U.S. Application Data

(60) Provisional application No. 60/232,799, filed on Sep. 15, 2000.

(51) Int. Cl.[7] ..... A63B 49/00; A63B 69/38; A63B 59/00

(52) U.S. Cl. ..... 473/524; 473/553; 473/463

(58) Field of Search ..... 473/524, 553, 473/527, 461, 463, 224, 234, 247, 116; 482/81, 82

(56) References Cited

U.S. PATENT DOCUMENTS 4,222,563 A * 9/1980 Keftler et al.
4,363,484 A * 12/1982 Breslow et al. ..... 463/3
4,699,375 A * 10/1987 Appelbaum et al. ..... 482/74
4,749,183 A * 6/1988 Cho ..... 482/50
4,822,042 A * 4/1989 Landsman ..... 340/323 R
4,911,441 A * 3/1990 Brunner
5,409,213 A * 4/1995 Yeh
5,646,911 A * 7/1997 Davis
5,672,131 A * 9/1997 Osborne et al.
5,816,580 A * 10/1998 Osborne et al.
5,839,958 A * 11/1998 Ozarow ..... 273/148 R
5,989,120 A * 11/1999 Truchsess ..... 463/36
6,273,421 B1 * 8/2001 Thalheimer et al.

FOREIGN PATENT DOCUMENTS

DE 2942533 * 4/1981 ..... 473/FOR 171
DE 4007549 * 9/1991 ..... 473/FOR 183
WO 94/27683 * 12/1994 ..... 473/FOR 183

* cited by examiner

*Primary Examiner*—Raleigh W. Chiu
(74) *Attorney, Agent, or Firm*—Vidas, Arrett & Steinkraus, P.A.

(57) ABSTRACT

A counting racket comprises a racket assembly defined by a handle, a throat and a racket face. The throat extending from the handle to the racket face. The racket assembly housing a electronic components which comprise: a controller, a memory, a power source, an acoustic sensor, a speaker, and at least one switch. The electronic components constructed and arranged to count a number of hits made when an object strikes the racket face. The electronic components further constructed and arranged to audibly recite the number of hits made by the object against the racket face.

18 Claims, 4 Drawing Sheets

Detailed Flow Chart

Legend: [R] = Restart button; TC = Time Counter; HC = Hit Counter; RC = Repeat Counter; BC = Best Score Counter; S= Sound/Voice,

| # | State Name | MCU action | Input/Interrupt | Result | Then goto # |
|---|---|---|---|---|---|
| 00 | Sleep | | [R] | HC = D, RC = D | 10 |
| 10 | Game On | If HC = 0 then S = "Ready", Else S = value of HC in words TC = 0 and counts time | Hit | HC = HC+1 | 10 |
| | | | TC = 20s | - | 20 |
| | | | | If BC < HC - then BC = HC HC = 0 | 10 |
| | | | [R] for 2 sec. | | 30 |
| 20 | Fun Talk | If Rc = 6 then go to #40, else S = fun talk (random select) TC = 0 and counts | Hit | RC = 0 | 10 |
| | | | TC = 20s | RC = RC+1 | 20 |
| 30 | Score | S = value of BC in words | After Finish | - | 10 |
| | | | [R] for 2 sec. | BC = 0 | 10 |
| 40 | End | S = "Bye Bye" | | | 00 |

List of recordings (total 16 secs) -

| | |
|---|---|
| Number Elements (18) | one, two, three, four, five, six, seven, eight, nine, ten, eleven, twelve, thir, teen, fif, twen, ty, hundred, |
| Others | Ready, Best Score, Bye Bye |
| Fun Talk | 1) Don't let me wait....<br>2) Are you asleep?.....<br>3) Come on! Let's play!<br>4) ....Ah! I'm tired of waiting... |

FIG. 4

| # | State Name | MCU action (do in sequence, If shown input then goto, If no input shown in table - proceed directly to 'Goto' | Input | Goto # |
|---|---|---|---|---|
| 00 | Off/ Sleep | Save BC, MC unchanged[2]<br>Low power state | ON | 10 |
| 10 | Say Mode | If MC = 1 then S = '1' 'player', 1 sec space<br>else S = '2' 'player', 1 sec space | | 20 |
| 20 | Ready | S = 'Ready' | Hit | 29 |
| | | | Start | 28 |
| | | | Score | 25 |
| | | | Mode | 27 |
| 23 | 2pl Start | If MC = 2 then HC = -1<br>and S = 'You Start' | Hit | 30 |
| 25 | Check Score | S = 'Game Score' value of HC (full form),<br>S = 'Best' 'Game Score' value of BC (full) | | 20 |
| 27 | Set Mode | Toggle MC = 1 <----> 2 | | 10 |
| 29 | Reset Score | HC = 0 | | 30 |
| 30 | Play | If MC = 1 then HC = HC+1, TC = 2sec<br>else HC = HC+2, TC = 6sec<br>S = Value of HC (short form) | | 30 |
| | | | TC = 0 | 35 |
| 35 | Time out | S = ping, 1 sec space, 'game score', value of HC (full form) | | 40 |
| 40 | Set BC | If BC < HC then BC = HC, and S = 'ta da', 1 sec space, 'new' 'best' 'game score' value of HC (full) | | 20 |
| | | Else | | 50 |
| 50 | Fun Talk | If HC = BC then S = 'best' 'game score'<br>If HC > 7/8" BC then S = 'almost' 'best' 'game score'<br>If HC < 1/8" BC then S = 'aaap' 'terrible'<br>else S = 'not bad' | | 20 |
| | Anytime in game | | | |
| | Event | Interrupt | Do | Goto |
| 61 | Reset BC | Press + Hold SCORE for 2 secs | BC = 0 | Back |
| 62 | Time Out | No input for 2 mins | | 00 |
| 63 | Sound | MUTE | Toggle speaker on <---> off<br>(Note: Even when OFF, still program runs as before). | Back |
| 64 | Restart | ON / START | HC = 0 | 20 |

List of recordings (total 18 secs) -

| | |
|---|---|
| Numbers (20) | Zero, one, two, three, four, five, six, seven, eight, nine, ten, eleven, twelve, thir, teen, fif, twen, ty, hundred, thousand |
| Words (9) | Ready, new, best, game score, almost, you start, aaap terrible, not bad, player |
| SFX (2) | 'Ta da', 'ping' |

[2] After reset or battery change - MC = 1 ; BC = 0

FIG. 5

COUNTING RACKET

CROSS-REFERENCE TO RELATED APPLICATIONS

This application claims priority from US provisional application No. 60/232,799, filed Sep. 15, 2000, the entire contents of which are incorporated herein by reference.

BACKGROUND OF THE INVENTION

In the past, games such as squash, badminton, table tennis, tennis, and/or racket ball have utilized rackets for players to score points within a game. In these games, scoring has occurred by forcing an opponent to miss a shot where each missed shot either transferred service or the missed shot was counted as a point for a serving player.

Other types of racket games are known where the goal of the game is to count consecutive hits by a player for as long a period of time as possible. Games of this type are kadima and/or matkot which focus on team cooperation to improve scoring.

A problem with the counting games as known is the concentration required to consecutively hit a ball while simultaneously accurately counting the number of hits. An individual focusing or concentrating on striking a ball frequently loses count of the exact number of consecutive hits. An individual concentrating on accurately counting the number hits frequently fails to provide sufficient concentration to strike a ball resulting in a missed shot and the end of the game.

In light of the above it would be desirable to provide a racket or paddle device which simultaneously counts consecutive hits and audibly recites and/or records the number of consecutive hits which have occurred during a period of the use of the racket.

The entire content of any patents listed within the present patent application are incorporated herein by reference.

The invention in various of its embodiment is summarized below. Additional details of the invention and/or additional embodiments of the invention may be found in the Detailed Description of the Invention below.

BRIEF SUMMARY OF THE INVENTION

The present invention may be embodied in a variety of different embodiments. In general the invention is directed to a novel counting racket and methods of its use. Preferably, the inventive counting racket employs a relatively simple and inexpensive design, construction, and operation, wherein the counting racket counts the number of hits upon a racket and provides an audible signal as to the amount of consecutive hits without fear of injury to persons and/or damage to property.

In at least one embodiment of the invention the counting racket comprises a racket or paddle having a processor, an acoustic sensor, and a speaker. In this embodiment the counting racket may be configured to count consecutive hits and recites the number of hits either consecutively for one player, or alternatively for two players. The recitation of hits may occur as the hits are made by the racket or the number of hits may be recorded by the processor for recitation at a later time.

In at least one embodiment of the invention the counting racket employs a memory having preprogrammed phrases providing predetermined phrases during the use of the racket. Such phrases may be of an encouraging, humorous, and/or sarcastic nature. For example, if an extended period of time passes without a successful hit the processor may be programed to play one or more of a selection of preprogramed humorous or sarcastic comments stored in the memory of the racket.

In at least one embodiment of the invention the counting racket has an aperture adapted to receive an elastic cord which is secured to a ball.

In at least one embodiment of the invention the counting racket is provided with a hardened racket face having an acoustic sensor receptive to receive and record a strike of a ball upon the racket. The received sound may be recorded or otherwise stored in the memory for playback at a latter time.

In at least one embodiment of the invention, the counting racket includes a handle which is adapted to receivingly hold a controller, a memory, and a power source.

In at least one embodiment of the invention, the counting racket includes a throat extending from a handle where the throat preferably includes an acoustic sensor, a speaker, and at least one switch.

In at least one embodiment of the invention, the counting racket includes an acoustic sensor, speaker and at least one switch which are in communication with the controller, memory, and the power source for counting strikes upon a racket and audibly signaling the number of strikes occurring within a game.

In at least one embodiment of the invention, the racket includes a memory having pre-stored audible numeric signals and/or humorous, encouragement, and/or sarcastic phrases to be signaled during a game.

In at least one embodiment of the invention, the racket provides for a racket or paddle face extending from a throat where the paddle is adapted to strike a ball during use of the counting racket within a game.

Additional details and/or embodiments of the invention may be found below.

BRIEF DESCRIPTION OF THE SEVERAL VIEWS OF THE DRAWINGS

A detailed description of the invention is hereafter described with specific reference being made to the drawings in which:

FIG. 4 is a flow chart diagram and recording list of an embodiment of the invention; and FIG. 5 is a flow chart diagram and recording list of an embodiment of the invention.

DETAILED DESCRIPTION OF THE INVENTION

Figure 1:
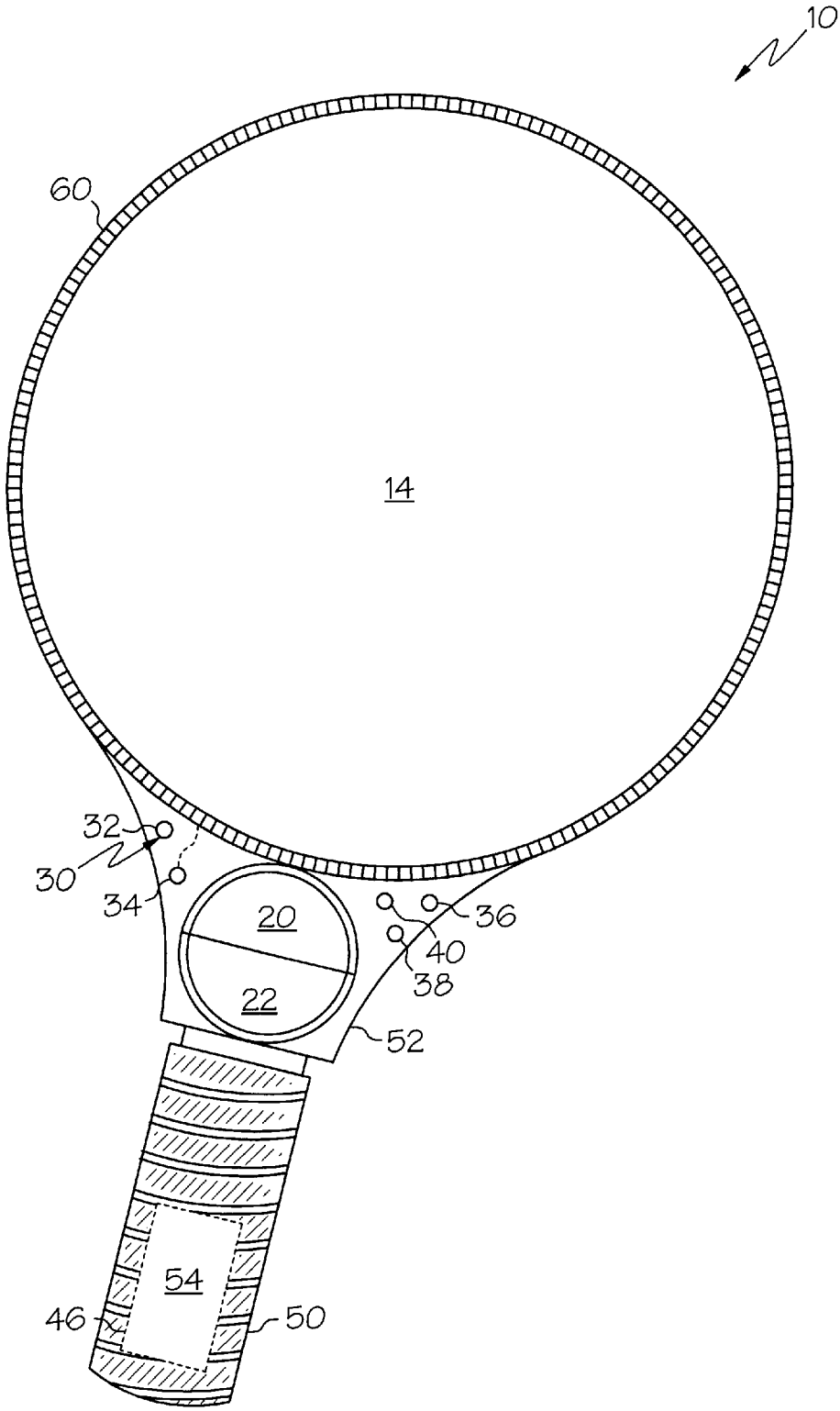
FIG. 1 is a perspective view of an embodiment of the invention.
Figure 2:
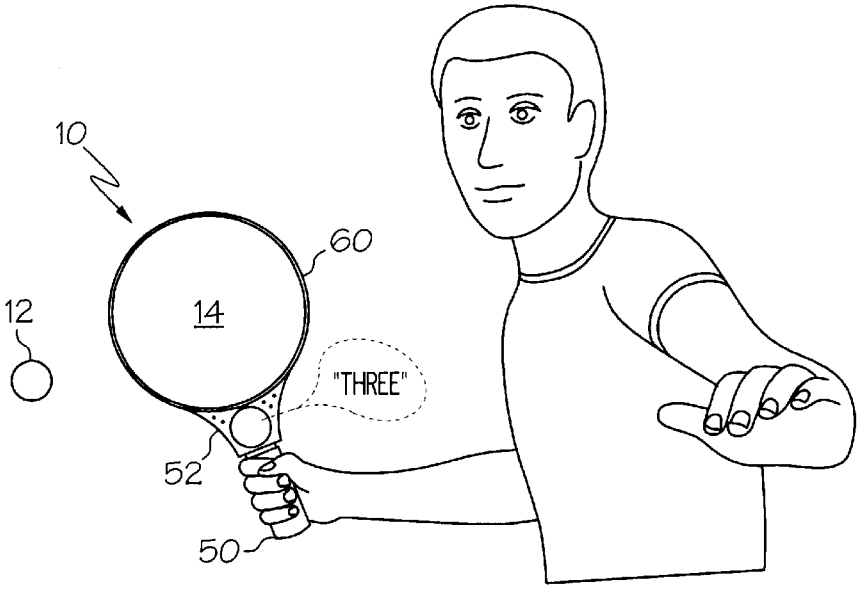
FIG. 2 is a view of an embodiment of the invention shown in its environment of use.

As indicated above the present invention is directed to a counting racket, indicated generally at 10 in FIG. 1, which may be configured to count and audibly recite the number of times the racket 10 strikes an object such as for example, a game ball 12 shown in FIG. 2.

In FIG. 2, an embodiment of the racket 10 is shown wherein the racket 10 is configured for single player use. When configured for single player use, the racket 10 may be provided with ball 12 which is secured to the racket face 14 by an elastic cord 16. The elastic cord 16 may be releasably attached to the racket 10, to allow the racket 10 to be converted from single player to multiple player use.

The racket 10 shown in FIGS. 1 and 2 is comprises a racket assembly 60 which is made up of a handle 50, a throat 52, and a paddle or racket face 14. The racket assembly 60 houses various electronic components, indicated generally at 15 in FIG. 3, which are described in greater detail below.

Figure 3:
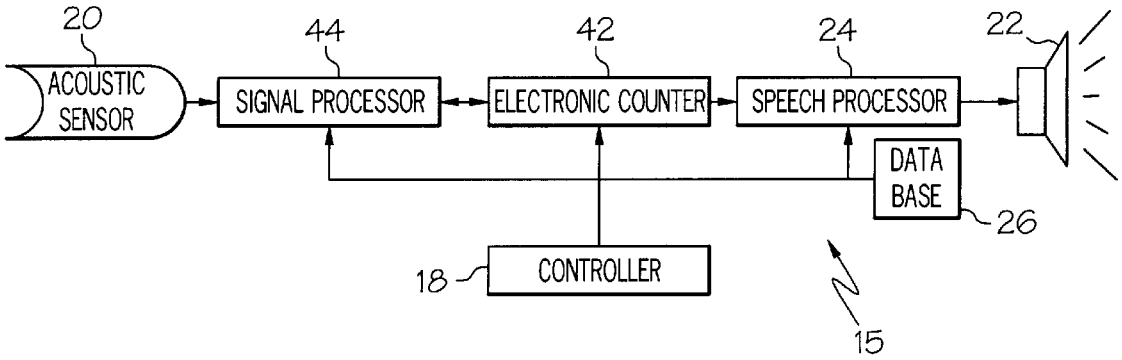
FIG. 3 is a flow chart/block diagram for the counting and speech generation for an embodiment of the invention.

The racket 10 includes a controller 18 such as a microprocessor, shown in FIG. 3, which consecutively counts signals as generated by an acoustic sensor 20 which detects consecutive strikes of the ball 12 upon the racket face 14. In another embodiment, the controller 18 accesses a second algorithm which signals alternative counts as generated by the acoustic sensor 20, representing either an odd or even number of consecutive strikes between two players, thereby allowing opponents using rackets of the present invention to keep individual scores.

As indicated above, the counting racket 10 may be provided with an acoustic sensor 20 utilized to detect strikes upon a racket 10 by a ball 12. Alternatively the acoustic sensor may be some other type of sensor such as a contact sensor which detects the impact of the ball 12 by its force of impact on the racket face 14 rather than by detecting the acoustic energy or sound of the impact.

The counting racket 10 also preferably includes a speaker 22 which may be used to audibly announce consecutive strikes upon the racket 10. The speaker 22 may also be used to audibly announce words and/or phrases as generated by a speech processor 24 which may be programmed for a variety of languages. The phrases generated by the speech processor 24 may be of any nature. Typically such phrases will be motivational, provide encouragement, or they may even be sarcastic, and/or humorous. The words and/or phrases recited by the speech processor 24 may be selected, modified or provided at the preference of an individual.

Audible numbers announced by the speaker 22 may be preferably stored within a vocal database 26 which simultaneously stores the audible speech during use of the counting racket. The controller 18 is preferably provided within the counting racket 10 to control the access of signals for generation of the recognizable audible numbers from the speech processor 24 representative of the counts as recorded by the acoustic sensor 20.

As is shown in the embodiment of FIG. 1, the counting racket preferably also includes a plurality of switches 30 in electronic communication with the controller 18. An first switch 32 for starting of a game, a mode switch 34 for selecting a one or two player mode, a mute switch 36 for turning the sound on or off, a score switch 38 which will signal the controller 18 to state or repeat a recorded score, and/or a high score switch 40 which will signal the controller to retrieve the highest score as stored within a memory or electronic counter 42 for communication to an individual.

The counting racket 10 may also include an electronic counter 42 which is in communication with the acoustic sensor 20 to record and translate acoustic signals as generated during the striking of a ball 12 upon the racket face 14 of the racket 10.

In general, the acoustic sensor 20 hears the ball 12 striking the face 14 of the racket 10 and generates a signal. The signal from the acoustic sensor 20 is received by a signal processor 44 which emits a digital signal for transmission to the electronic counter 42. The electronic counter 42 advances the count by either an increment of one, two, or by some other value, according to the preselected mode as activated by the mode switch 34.

As indicated above, the electric counter 42 also has a high score memory access which stores a hall of fame or high score for comparison to the current game for an individual. The hall of fame or high score is preferably stored within the electronic memory or storage unit to be compared to the best score achieved during any particular game.

The electronic counter 42 preferably generates a signal, where the signal is transmitted to the signal processor 44. The processor 44 in turn, compares the signal to the best score as stored within the memory of the counter 42 for placement as appropriate. The signal processor 44 also sends a signal to the vocal database 26 for selection of an audible signal. The signal processor 44 further sends a signal to the speaker 22 for generation of an audible signal representative of the consecutive hits. The signal as retrieved from the database 26 of signals is preferably an audible number which corresponds to the number of hits detected. Alternatively, a predetermined phrase may be substituted for, or provided in addition to the audible number.

The speech processor 24 receives a signal from the signal processor 44 or electronic counter 42 and converts the electric signal into a verbal or audible score. The verbal or audible score is transmitted through the speaker 22 for detection by an individual. An individual may receive a high score by activation of the high score button or switch 40 where the signal for the high score is retrieved by the electric counter 42 from memory for audible generation by the speech processor 24 and speaker 22.

As may best be seen in FIG. 1, the counting racket 10 is preferably formed of rugged plastic and/or wooden material. The racket includes a handle 50 which is preferably formed of rugged plastic material having an internal cavity which is adapted to receivingly engage the electronic components of the racket namely: the controller 18 and a power source 46. Other components as have been discussed herein may also be housed in the handle 50.

The racket 10 may also include a throat 52. The throat 52 extends from handle 50 to engage the racket face 14. The throat 52 is preferably also formed of sturdy plastic and/or wooden material and is adapted for receiving engagement of the acoustic sensor 20, speaker 22, and at least one switch 30. Electrical contacts and/or wires preferably provide electronic communication between the various electronic components such as the controller 18, power source 46, acoustic sensor 20, speaker 22, and at least one switch 30.

The power source 46 for the counting racket 10 is preferably batteries which may be releasably secured within the handle 50 via a screw access panel 54.

The counting racket 10 also preferably includes a sleep mode which deactivates and terminates power to the electrical components when the acoustic sensor 20 does not receive a signal from a ball strike for a predetermined period of time, such as for example, approximating three minutes.

The various modes, functions and combinations thereof of two embodiments of the invention are provided in the flow charts shown in FIGS. 4 and 5 respectively.

In addition to being directed to the specific combinations of features claimed below, the invention is also directed to embodiments having other combinations of the dependent features claimed below and other combinations of the features described above.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In urisdictions where multiple dependent claim formats are restricted, the following dependent claims should each be also taken as alternatively written in each singly dependent claim format which creates a dependency from a prior antecedent-possessing claim other than the specific claim listed in such dependent claim below.

What is claimed is:

1. A counting racket comprising:

a racket assembly the racket assembly defined by a handle, a throat and a racket face, the throat extending from the handle to the racket face;

the racket assembly housing electronic components, the electronic components comprising: a controller, a memory, a power source, an acoustic sensor, a speaker, and at least one switch;

the electronic components constructed and arranged to count a number of hits made when an object strikes the racket face, the electronic components further constructed and arranged to audibly recite a verbal representation of the numeric identifier of the number of hits made by the object against the racket face.

2. The counting racket of claim 1 wherein the controller, the memory and the power source are positioned within the handle.

3. The counting racket of claim 1 wherein the acoustic sensor, the speaker, and the at least one switch are at least partially positioned within the throat.

4. The counting racket of claim 1 wherein the acoustic sensor, the speaker, and the at least one switch are in electronic communication with the controller, the memory, and the power source.

5. The counting racket of claim 1 wherein the acoustic sensor is constructed and arranged to audibly detect the number of hits made by the object against the racket face.

6. The counting racket of claim 1 wherein the memory comprises an electronic counter, the electronic counter constructed and arranged to provide a count of the number of hits made by the object against the racket face.

7. A counting racket comprising:

a racket assembly the racket assembly defined by a handle, a throat and a racket face, the throat extending from the handle to the racket face;

the racket assembly housing electronic components, the electronic components comprising: a controller, a signal processor, a memory, a power source, an acoustic sensor, a speaker, and at least one switch;

the electronic components constructed and arranged to count a number of hits made when an object strikes the racket face, the electronic components further constructed and arranged to audibly recite the number of hits made by the object against the racket face;

the memory comprising an electronic counter, the electronic counter constructed and arranged to provide a count of the number of hits made by the object against the racket face;

the signal processor being in electrical communication with the controller, the acoustic sensor and the electronic counter, the signal processor constructed and arranged to receive at least one acoustic signal from the acoustic sensor and convert the at least one acoustic signal into a digital signal, the digital signal being communicated to the electronic counter.

8. The counting racket of claim 7 wherein when the electronic counter receives the digital signal from the signal processor, the electronic counter is constructed and arranged to advance the count by a predetermined increment.

9. The counting racket of claim 8 wherein the at least one switch comprises a mode switch the mode switch in communication with the electronic counter, the mode switch constructed and arranged to provide the predetermined increment.

10. The counting racket of claim 9 wherein the predetermined increment is one or two.

11. The counting racket of claim 10 further comprising a speach processor, the speach processor constructed and arranged to receive at least one signal from at least one of the signal processor and electronic counter, the speach processor further constructed and arranged to convert the at least one signal into an audible score, the audible score being transmitted through the speaker.

12. The counting racket of claim 11 wherein the audible score comprises one of a range of audible phrases selected from a range of numerical values from 1 to at least 100.

13. The counting racket of claim 12 further comprising a speach data base for storing the range of audible phrases, the speach database being accessed from at least one of the controller and the speach processor.

14. The counting racket of claim 13 wherein the speech data base is configured to additionally store one or more phrases, at least one of the one or more phrases being selectively audibly produced by at least one of the speech processor and controller.

15. The counting racket of claim 1 wherein the at least one switch comprises and power switch for supplying and cutting power from the power source to the controller.

16. The counting racket of claim 1 wherein the at least one switch comprises a score switch for accessing the memory to audibly produce the number of hits.

17. The counting racket of claim 1 wherein the at least one switch comprises a mute switch for providing and cutting power to the speaker.

18. The counting racket of claim 1 wherein the racket housing is constructed from wood, plastic or a combination thereof.

* * * * *